US006464385B2

(12) United States Patent
Akimoto et al.

(10) Patent No.: US 6,464,385 B2
(45) Date of Patent: Oct. 15, 2002

(54) METHOD AND APPARATUS FOR PREPARING SLURRY FROM STARTING MATERIALS

(75) Inventors: Hiromiti Akimoto, Tokyo (JP); Ryouji Sunama, Tokyo (JP)

(73) Assignee: Kyowa Vacuum Engineering Ltd, Tokyo (JP)

( * ) Notice: Subject to any disclaimer, the term of this patent is extended or adjusted under 35 U.S.C. 154(b) by 16 days.

(21) Appl. No.: 09/811,571

(22) Filed: Mar. 20, 2001

(65) Prior Publication Data

US 2002/0051406 A1 May 2, 2002

(30) Foreign Application Priority Data

Oct. 30, 2000 (JP) ..... 2000-330640

(51) Int. Cl.[7] ..... B01F 13/06; B01F 15/02

(52) U.S. Cl. ..... 366/131; 366/182.2; 366/341; 366/177.1; 366/181.8; 366/163.1

(58) Field of Search ..... 366/341, 131, 366/134, 182.2, 136, 348, 349, 137, 182.1, 182.3, 182.4, 172.1, 177.1, 181.8, 163.1, 101, 106

(56) References Cited

U.S. PATENT DOCUMENTS 2,226,126 A * 12/1940 Malsbary et al.
2,266,125 A * 12/1941 Malsbary et al. ..... 366/136
3,773,301 A * 11/1973 Bergeron ..... 366/163.1
4,673,296 A * 6/1987 Sjogren ..... 366/163.1

* cited by examiner

*Primary Examiner*—Tony G. Soohoo
(74) *Attorney, Agent, or Firm*—Browdy and Neimark, P.L.L.C.

(57) ABSTRACT

A material blending tank 1 is formed in a pressure-resistant, and tightly closable vessel, in its inner cavity, into which predetermined quantities of starting materials are charged, followed by hermetically sealing the tank; a material adjusting tank 2 is formed in a large size, into which a predetermined quantity of solvent is filled so as to be able to pump out from its bottom part by means of a pump P; the pump P functioning to pressure-feeding the solvent pumped out of the material adjusting tank 2 into the inner cavity of the material blending tank 1 through its bottom side. In the course of the pressure-feeding of the solvent, when the air within the material blending tank 1 is compressed to a high pressure level, the operation of the pump P is stopped and the solvent which has been pressure-fed into the material blending tank 1 is subjected to reverse flow through the inner cavity of the pump P into the material adjusting tank 2 by the pressure of the air compressed in the material blending tank 1. Subsequently, the process steps of: the pressure-feeding of the solvent into the material blending tank 1 due to re-starting of the pump P; and the reverse flow of the solvent into the material adjusting tank 2 due to stoppage of the pump P are repeated for a plurality of number of times to dissolve the starting materials into the solvent, thereby making it into slurry.

5 Claims, 2 Drawing Sheets

METHOD AND APPARATUS FOR PREPARING SLURRY FROM STARTING MATERIALS

BACKGROUND OF THE INVENTION a) Field of the Invention

This invention relates to a method for preparing starting materials in the form of slurry by dissolving various starting materials to be used in the production of medicaments, etc. into a dissolving medium such as additives. It is also concerned with an apparatus for adjusting such starting materials.

b) Description of Prior Arts

In the conventional technique, the apparatus for adjusting the starting materials, by which various materials for use as the starting material of a desired product is dissolved into a dissolving medium and well mixed by agitation, is of such a construction that, as shown in FIG. 1 of the accompanying drawing with this application, a plurality of blending tanks 1, 1, . . . are provided in juxtaposition, each tank having a material charging port 10 therein and being equipped with an agitator 11 inside it; and, apart from this, a large-sized adjusting tank 2 having a material feeding port 20 and being equipped with an agitator 21 inside thereof is provided. The operational functions of this material adjusting apparatus are as follows: that is to say, when those various starting materials are adjusted into slurry of a predetermined composition, such various materials are weighed for each component material by use of a separately provided weighing instrument, and each of these materials as weighed is charged into each of the plurality of material blending tanks 1, 1, . . . which are juxtaposed each other; subsequently, a solvent adapted to each individual material is charged, in its predetermined quantity, into the material blending tank 1, in which the material corresponding to such solvent has been charged; as soon as these materials and solvents are completed their charging, each of the agitators 11, 11, . . . installed in each of the blending tanks 1, 1, . . . is driven by actuating a motor 12, 12, . . . , and, while dissolving the material into the solvent, the material is well mixed into the solvent, thereby perfectly dissolving the material into the solvent; then, a discharge port 13 in each of the blending tanks 1, 1, . . . is opened to take out the mixture solution which is charged into the feeding port 20 of the material adjusting tank 20, with further addition of a solvent or distilled water in its predetermined quantity; in this state, the agitator 21 installed within the material adjusting tank 2 is driven by actuation of the motor 22 to proceed with agitating and mixing of the material solution and the solvent to adjust the mixture solution into the intended slurry; and that, as the final operational step, a discharge port 23 of the material adjusting tank 2 is opened to pump up the slurry by means of the pump P by communicatively connecting the intake side of the pump P to its discharge port, followed by guiding the slurry to a predetermined location through a pipeline 24, the end of which is communicatively connected to the outlet side of the pump P.

The above-described conventional expedient possesses problems such that, when the starting material and the solvent, each of which is weighed to its predetermined quantity and has been charged in each blending tank 1, are to be agitated and dissolved by means of the agitator 11 installed in each blending tank 1, considerable time is taken until the entire starting material charged into the blending tank attains a state of its being completely dissolved into the solvent as added, because, in most cases, a part of the material as charged remains undissolved in the blending tank.

Moreover, there is an additional problem such that, upon completion of dissolving and blending of the starting material, when a different starting material is to be dissolved in the same blending tank, much time is still needed for perfectly removing the starting material and the mixture solution adhered onto the agitating blades of the agitator 11.

The conventional apparatus has further problem such that much time is taken until homogeneous slurry is obtained as a whole, in the step of adjusting various sorts of solutions in the material adjusting tank 2 by fluidizing them through agitation by means of the agitator 21, because the flow of the material solutions, generated in the material adjusting tank 2 by the agitator 21 in a giratory manner therewithin, brings about a portion having a low flow rate at a position closer to the inner wall surface of the material adjusting tank 2 as well as the center position of the agitator 21. Furthermore, when the interior of the material adjusting tank is to be washed for adjusting the subsequent liquid materials into the slurry, much time is also taken to cleanly wash the peripheral surface of the agitator 21 with its external surface assuming a complex shape, which brings about another problem.

Moreover, there is a problem of increased cost for the installation due to equipment of the agitators 11, 11, . . . , and 21 in each of a plurality of material blending tanks 1, 1, . . . and the material adjusting tank 2, and incorporation of driving means such as motors 12, 12, . . . , and 22 for actuating such material blending tanks and material adjusting tank.

There still exist a problem such that, when the starting materials are charged into the material blending tank 1 and the material adjusting tank 2 through their charging port 10 and feeding port 20, respectively, the materials tend to scatter around the exterior of the tanks or to stick onto the wall surface of the tanks.

The present invention has been made with a view to solving the above-described various points of problems inherent in the conventional material adjusting apparatus, and aims at providing a novel expedient which is capable of perfectly dissolving the starting materials into solvent, and of carrying out the homogeneous slurry forming operations in a short period of time, without use of an agitator which is expensive in installation cost and troublesome in its cleaning operation.

According to the present invention, in one aspect thereof, there is provided a method for adjusting starting materials to prepare the starting materials in the form of a slurry by dissolution of such starting materials into a solvent, which comprises steps of: charging predetermined quantities of starting materials into an inner cavity of a material blending tank 1 which is constructed in a pressure-resistant and tightly closed version, followed by hermetically sealing the same; filling, in advance, a predetermined quantity of solvent in a large-sized material adjusting tank 2; pumping out said solvent from the bottom part of said material adjusting tank 2 by means of a pump P, and feeding said solvent into the inner cavity of said material blending tank 1 from the bottom part thereof by means of said pump P; stopping operation of said pump P as soon as the air within said material blending tank 1 becomes compressed to a high pressure level, and causing said solvent, which has been pressure-forwarded into said material blending tank 1 to flow in the reverse direction into said material adjusting tank 2 through the inner cavity of said pump P under the pressure of air compressed in said material blending tank 1; and repeating, for a plurality of number of times, the pressure-feeding of said solvent into said material blending tank 1 by the operation of the pump P, and the reverse flow of said solvent into said material adjusting tank 2 by the stoppage of said pump P.

According to the present invention, in another aspect thereof, there is provided a method for adjusting starting materials to adjust the starting materials into a slurry by dissolution of such starting materials into a solvent, which comprises steps of: charging predetermined quantities of a starting material into an inner cavity of a material blending tank 1 which is constructed in a pressure-resistant and tightly closed version, followed by hermetically sealing the same; filling, in advance, a predetermined quantity of solvent in a large-sized material adjusting tank 2; pumping out said solvent from the bottom part of said material adjusting tank 2 by means of a pump P, and feeding said solvent into the inner cavity of said material blending tank 1 from the bottom part thereof by means of said pump P; stopping operation of said pump P as soon as the air within said material blending tank 1 becomes compressed to a high pressure level, and causing said solvent, which has been pressure-forwarded into said material blending tank 1 to flow in the reverse direction into said material adjusting tank 2 through the inner cavity of said pump P under the pressure of air compressed in said material blending tank 1; repeating, for a plurality of number of times, the pressure-feeding of said solvent into said material blending tank 1 by the operation of the pump P, and the reverse flow of said solvent into said material adjusting tank 2 by the stoppage of said pump P; and, thereafter, opening a duct line d which communicatively connects the upper part of the material blending tank 1 with the material adjusting tank 2 to cause the solution composed of a solvent within said material adjusting tank 2 and the starting material dissolved in said solvent to flow by the operation of the pump P, thereby sending said solution back into said material adjusting tank 2 by way of said material adjusting tank 2, said pump P, said material blending tank 1, and said duct line d.

According to the present invention, in still another aspect thereof, there is provided a starting material adjusting apparatus for preparing the starting materials in the form of slurry, which comprises: a material blending tank 1 formed in a tightly closable vessel, and provided with a material charging port 10 which is made tightly closable; a material adjusting tank 2 formed in large-size, and provided with a feeding port 20 of solvent to be filled in the interior of said tank; and a pump P for pressure-feeding said solvent filled in the interior of said material adjusting tank 2 into said material blending tank 1, the intake side of said pump P being connected to a discharge port 2*a* at the bottom part of said material adjusting tank 2 through a pipeline a, while the outlet side of said pump P being connected to a discharge port 13 at the bottom part of said material blending tank 1 through a pipeline b, and said pump P being adapted to enable the solvent to pass through the inner cavity thereof, during its stoppage of operation, in the direction of from the outlet side to the intake side thereof.

According to the present invention, in further aspect thereof, there is provided a starting material adjusting apparatus for adjusting the starting materials into slurry, which comprises: a material blending tank 1 formed in a tightly closable vessel, and provided with a material charging port 10 which is made tightly closable; a material adjusting tank 2 formed in large-size, and provided with a feeding port 20 of solvent to be filled in the interior of said tank; and a pump P for pressure-feeding the solvent filled in the interior of said material adjusting tank 2 into said material blending tank 1, the intake side of said pump P being connected to a discharge port 2*a* at the bottom part of said material adjusting tank 2 through a pipeline a, while the outlet side of said pump P being connected to a discharge port 13 at the bottom part of said material blending tank 1 through a pipeline b, and said pump P being adapted to enable the solvent to pass through the inner cavity thereof, during its stoppage of operation, in the direction of from the outlet side to the intake side thereof, and further, the upper part of said material blending tank 1 being communicatively connected to said material adjusting tank 2 through a duct line d which is controlled for its opening and closing by an opening-and-closing valve V6.

The foregoing objects, other objects as well as specific construction and operations of the method and the apparatus for adjusting the starting materials in the form of slurry will become more apparent and understandable from the following detailed description thereof, when read in conjunction with the accompanying drawing.

BRIEF DESCRIPTION OF THE ACCOMPANYING DRAWING

DETAILED DESCRIPTION OF PREFERRED EMBODIMENTS

Figure 1:
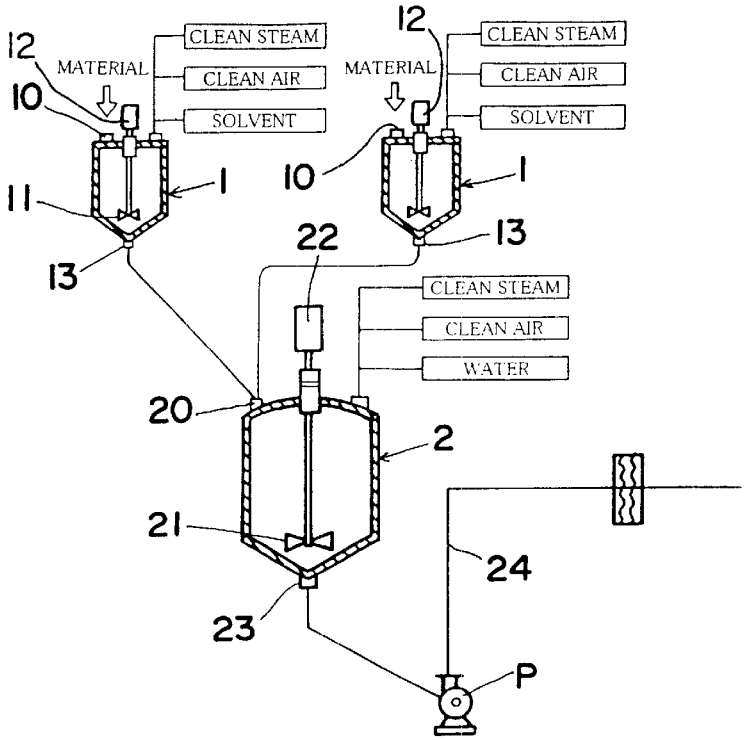
FIG. 1 is a developed diagram of a conventional material adjusting apparatus for preparing a starting material into slurry with use of a solvent.
Figure 2:
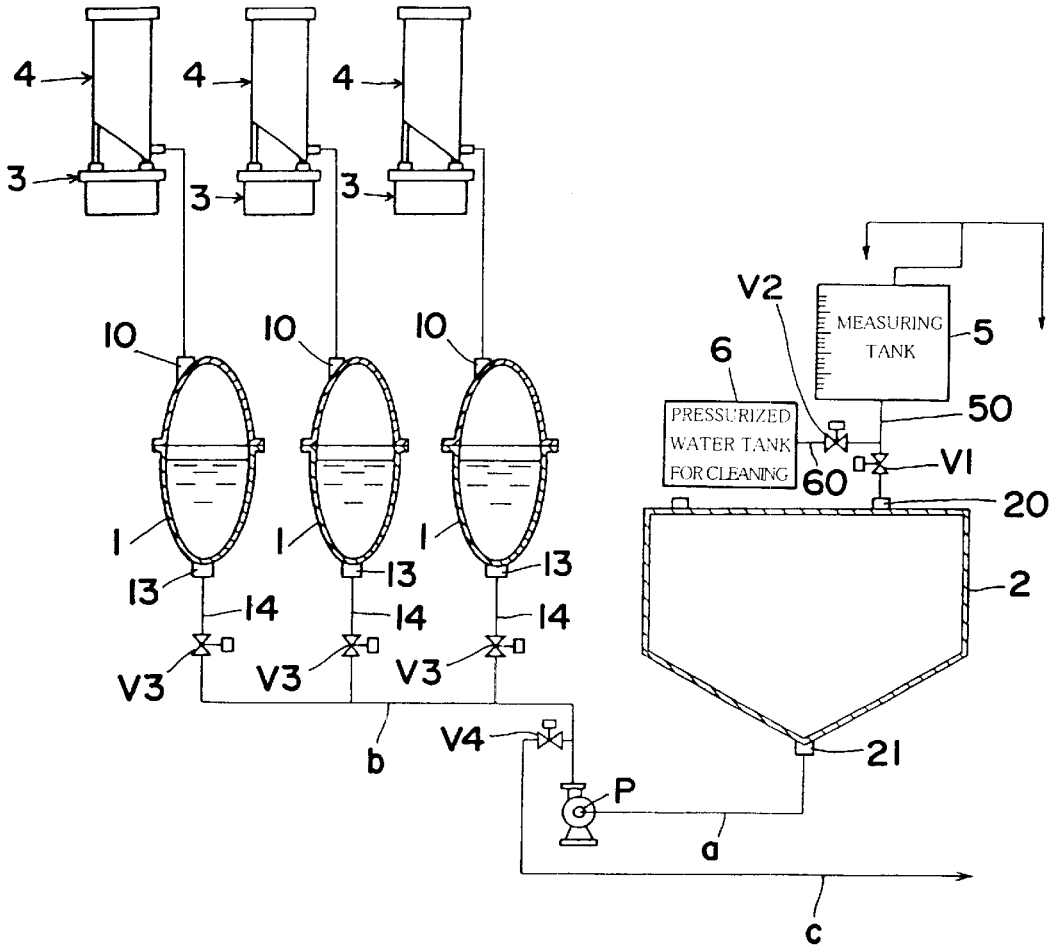
FIG. 2 is also a developed diagram of the material adjusting apparatus for preparing a starting material in the form of slurry, in accordance with the present invention.

The material adjusting apparatus according to the present invention is constructed with the following elements, for blending starting materials and solvent in a material blending tank, in which to charge predetermined quantities of starting materials as weighed: that is to say, a material blending tank 1 to charge therein with starting materials; a material adjusting tank 2 to fill therein with the solvent to be added to the starting materials in the material blending tank 1; and a pump P for pressure-feeding the solvent into the material blending tank 1 by pumping this solvent out of this material adjusting tank 2. This material blending tank 1 is formed in a tightly closable vessel which can be pressurized in its interior, a material charging port 10 adapted to be tightly closable being formed in one part thereof, through which the starting materials can be charged into the tank by human hands; or else, the upper part of this material blending tank is dismantled and the starting material is set in a pipeline carried inside as the tightly closed vessel, which has been weighed beforehand; or else, a starting material feeding tank 4, which weighs the starting material to a desired quantity by means of a weighing instrument 3 such as load cell, etc., and enables the material to be let out, is connected to this material charging port 10 so as to automatically feed the material, and this material blending tank 1 is installed in a single unit, or in a plurality of units in a mutually juxtaposed relationship.

As mentioned in the foregoing, the material adjusting tank 2 is formed in a large-scaled, tightly closable tank, and, with its upper side being defined with a solvent feeding port 20, through which the solvent is filled inside the tank 2. To this feeding port 20, there is connected, through a valve V1, a feeding pipe 50 which is communicated to a measuring tank 5 which measures and feeds the solvent so as to carry out thereby the filling of a predetermined quantity of the solvent, and also there is connected, through a valve V2, a feeding pipe 60 which is communicated to a washing-water tank 6 or a city-water-tap for feeding washing water for cleaning the interior of the material adjusting tank 2, the material adjusting tank 2 being disposed at a level lower than that of the abovementioned material blending tank 1, and positioned in the vicinity of the material blending tank 1. At this time, the above-mentioned washing water feeding pipe 60 to be connected to the material adjusting tank 2 is connected on the half way of the abovementioned solvent feeding pipe 50 through the valve V2, so that both cleaning water and solvent may be fed into the material adjusting tank 2 in a manner to be freely changed-over.

Of these material blending tank 1 and the material adjusting tank 2, the former (material blending tank 1) connects its lower pipeline 14 to its bottom discharge port 13, the lower pipeline 14 being, in turn, connected to a pipeline b which is connected to the outlet side of the pump P. In the meantime, the material adjusting tank 2 connects its bottom discharge port 2*a* with the pipeline a which is connected to the inlet side of the abovementioned pump P, whereby both material adjusting tank 2 and material blending tank 1 are rendered to be in a state of being communicatively connected each other through the pipeline a to the inlet side of the pump P, the pipeline b to the outlet side of the pump P, and the lower pipeline 14 as well.

At this time, if and when a multiple number of the material blending tanks 1, 1, . . . arranged side by side, the lower pipelines 14, 14, . . . connected to the bottom discharge port 13 of each material blending tank 1 is connected in parallel with the pipeline b at the outlet side, which, in turn, is connected to the pipeline b at the outlet side to be connected to the outlet side of the pump P. Moreover, to each of the lower pipelines 14, 14, . . . , there is connected individually a valve V3 so that these lower pipelines may be connected individually to the pipeline b at the abovementioned outlet side.

Further, to the pipeline b at the outlet side, there is connected through a change-over valve V4 the pipeline c for taking out the slurry, whereby the thus adjusted slurry may be pumped out in utilization of the pump P.

The starting material adjusting apparatus according to the present invention, for adjusting the starting materials into slurry, is fundamentally constructed with the above-described constituent elements.

When the starting materials are adjusted into slurry, a predetermined quantity of such starting materials, as weighed, is first of all charged into the material blending tank 1, followed by tightly closing the same, while a predetermined quantity of solvent, as measured, is charged into the material adjusting tank 2.

Subsequently, the pump P is actuated from the abovementioned state to pump out the solvent within the material adjusting tank 2 and to feed the solvent under pressure into the material blending tank 1.

In this way, the starting material within the material blending tank 1 is dissolved into the solvent which is fed under pressure, while the air within the material blending tank 1 is pushed upward within the material blending tank 1 by the solvent which is forwarded under pressure, whereby it is compressed. The compression of the air at this time may differ depending on the capacity of the pump P. In the case of an ordinary discharge pump, the air pressure might go up as high as 10 atm. or so, in the state of the solvent having been charged into the material blending tank 1, and the operation of the pump P being continued for a short while.

In the next place, after lapse of a certain definite time following the pressure feeding of the solvent, the operation of the pump P is stopped, whereby the solvent sent into the material blending tank 1 and the starting material dissolved in this solvent pass through the pump P, and reversely flow at once, into the material adjusting tank 2, by the pressure of the air compressed within the material blending tank 1 to vigorously shake the mixture solution in the material adjusting tank 2.

As the result of this concussion, if and when the air pressure within the material blending tank 1 comes closer to zero, the pump P is re-started to pressure-feed the solvent in the material adjusting tank 2 into the material blending tank 1, and, through the same process steps, the solvent is returned to the material adjusting tank 2. The process steps are repeated for a plurality of number of times.

In the case of multiple numbers of the material blending tanks 1, 1, . . . being arranged in a mutually juxtaposed relationship, these material blending tanks 1, 1, . . . are connected in sequence with the pipeline b at the feeding side so as to carry out dissolution into solvent for each and every starting material, whereby the starting material charged into the material blending tank 1 becomes washed by the solvent which is pressure-fed from the material adjusting tank 2 by the pump P, and dissolved into the solvent to become a solution. The thus obtained solution reversely flows, at once, into the material adjusting tank 2 by the pressure of the compressed air within the material adjusting tank 2. At the same time, the solvent and the solution in the material adjusting tank 2 are all vigorously shaken to be agitated and mixed thereby into slurry.

The thus prepared slurry is pumped out of the material adjusting tank 2 by means of the pump P through changing-over of the valve V4, and becomes able to be guided to a desired location through the pipeline c.

Figure 3:
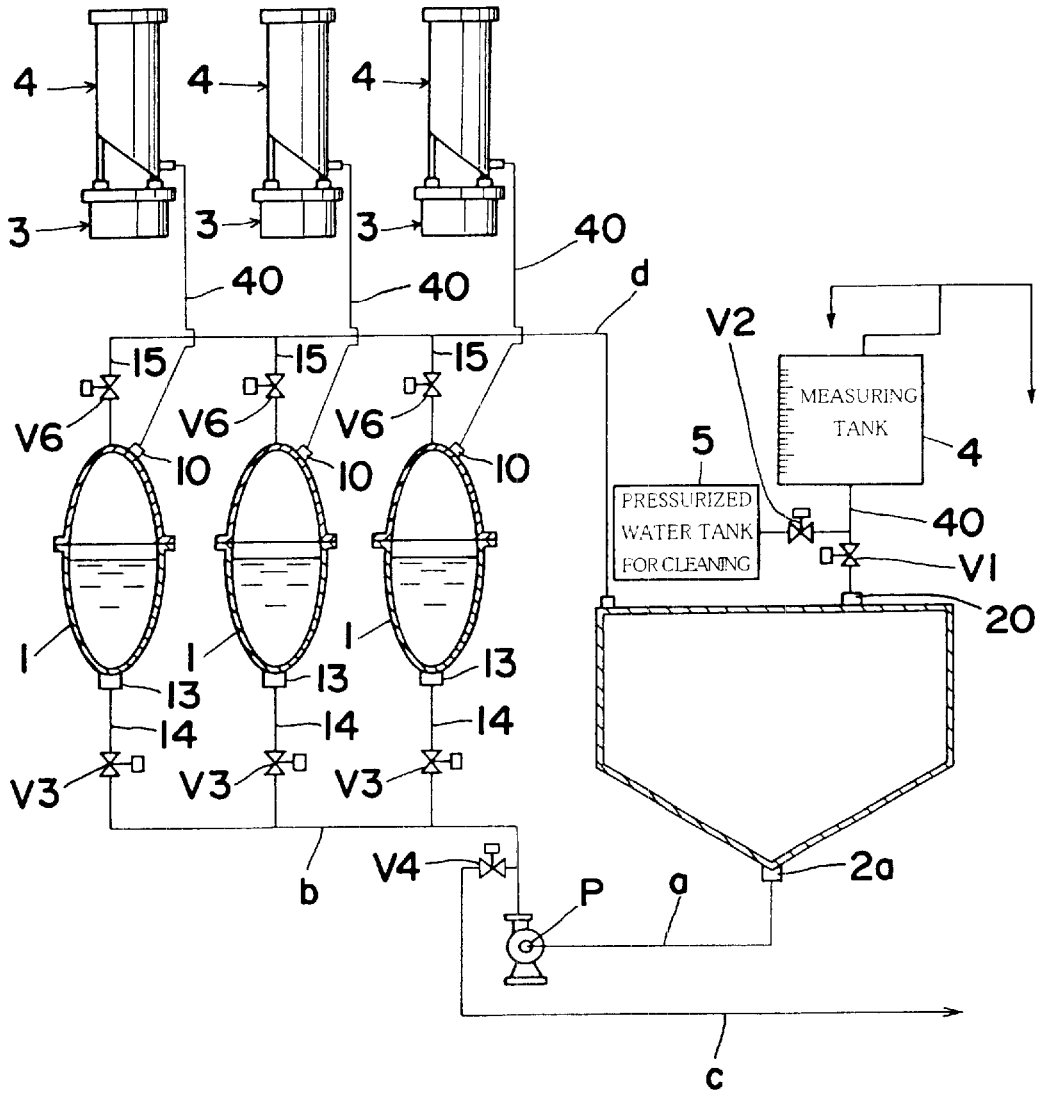
FIG. 3 is another developed diagram of the material adjusting apparatus, in accordance with the present invention, in its modified embodiment.

FIG. 3 illustrates another example of the present invention, wherein there is further added to the above-described starting material adjusting apparatus a process step of circulating the slurry which has been adjusted and prepared in the material adjusting tank 2, in such a manner as to be returned again to the material adjusting tank 2 through the pump P and the material blending tank 1.

In this example, the arrangement of the above-described starting material adjusting apparatus is such that an upper pipeline 15 is connected with the top part of the material blending tank 1, and this upper pipeline 15 is further connected to the end part of the upstream side of the duct line d, the downstream side of which is connected with the material adjusting tank 2. On the other hand, the abovementioned upper pipeline 15 is provided with an opening-and-closing valve V6 which is independently controlled its opening and closing. When the starting material is made into slurry, the valve V6 is first of all kept in its closed state, and the solvent in the material adjusting tank 2 is caused to reciprocally flow between the pressure feeding by the pump P and the material blending tank 1, by repetition of the operation and stoppage of the abovementioned pump P. Upon completion of these process steps, the abovementioned valve V6 is opened to actuate the pump P, thereby causing the solution within the material adjusting tank 2 to circulate in the sequence of the pump P, the material blending tank 1, the material adjusting tank 2, and the pump P.

In this example, too, when a multiple units of the material blending tank 1 are arranged in juxtaposition, the upper pipelines, 15, 15, . . . connected to the upper part of each of the material blending tanks 1 are connected in parallel with the duct line d, while the opening-and-closing valves V6, V6, . . . , which are individually controllable, are each connected with each of the upper pipelines 15, 15, . . .

In this example, in addition to blending by agitation of the starting materials and the solvent, wherein the solvent is caused to flow repeatedly between the material blending tank 1 and the material adjusting tank 2, the starting materials and the solvent are subjected to agitation by the forwarding blades of the pump P during the circulating flow, whereby the solution, in which the starting materials are dissolved, is more effectively turned into slurry. From this, it can be concluded that, in the case of the solvent being circulated, the blades of the pump P should preferably be made an open blade type, or a cut blade type having both agitating and shearing force.

As has so far been described in the foregoing, since the material adjusting apparatus according to the present invention, which turns the starting materials into slurry by dissolving the materials into the solvent, is of such construction that, on the one hand, a predetermined quantity of such starting materials are sealed in a tightly closable, material blending tank 1, and, on the other hand, the solvent, which is filled in the material adjusting tank 2, is charged in the interior of this material blending tank 1 by the pump P through its bottom side, so that, when the air within the material blending tank is compressed, the pump operation is stopped, and the solvent forwarded into the material blending tank 1 by the pressure of the air as compressed is caused to reversely flow into the material adjusting tank 2 at once, by repetition of which the starting materials can be dissolved into the solvent, and be turned into slurry. As the result, use of the agitator is no longer necessary, and the dissolution of the starting materials into the solvent as well as slurrying of such dissolved materials can be realized in a short period of time, with further merit such that there is no substance which remains undissolved due to scattering, etc. of the powder material.

After completion of the process step of the reciprocal flowing of the solvent between the material blending tank 1 and the material adjusting tank 2, by repetition of operation and stoppage of the pump P, if and when the solvent and the solution are subjected to their circulating flow in such process step that runs through the material adjusting tank 2, the pump P, the material blending tank 1, and the duct line d, to finally return to the material adjusting tank 2, the dissolution of the starting materials into the solvent, and their slurrying becomes more perfectly carried out. Further, foaming from the materials during the agitation can be reduced to a substantial extent. Moreover, since the material blending tank 1 may be charged with the starting materials which are weighed in a predetermined quantity, while the material adjusting tank 2 may be fed with a solvent which has been measured in a required quantity, the automatic feeding of the starting materials and the solvent becomes easy. By this automatic operation, the stationary washing (CIP) of the apparatus and the stationary steam sterilization (SIP) become readily put into practice, with further advantage such that the material adjusting guarantees the sterilized condition, on account of which the apparatus can be operated as the perfectly closed system against risk of contamination, hence the whole system becomes conformable to the international standards of HACCP and GMP. In the foregoing, the present invention has been described in detail with reference to the preferred embodiments thereof. It should however be noted that the invention is not limited to these embodiments alone, but any changes and modifications may be made within the spirit and scope of the invention as set forth in the appended claims.

What is claimed is:

1. A method for adjusting starting materials to prepare the starting materials into a slurry by dissolution of such starting materials into a solvent, which comprises steps of: charging predetermined quantities of starting materials into an inner cavity of a material blending tank 1 which is constructed in a pressure-resistant and tightly closed version, followed by hermetically sealing the same; filling, in advance, a predetermined quantity of solvent in a large-sized material adjusting tank 2; pumping out said solvent from the bottom part of said material adjusting tank 2 by means of a pump P, and feeding said solvent into the inner cavity of said material blending tank 1 from the bottom part thereof by means of said pump P; stopping operation of said pump P as soon as the air within said material blending tank 1 becomes compressed to a high pressure level, and causing said solvent, which has been pressure forwarded into said material blending tank 1 to flow in the reverse direction into said material adjusting tank 2 through the inner cavity of said pump P under the pressure of air compressed in said material blending tank 1; and repeating, for a plurality of number of times, the pressure-feeding of said solvent into said material blending tank 1 by the operation of the pump P, and the reverse flow of said solvent into said material adjusting tank 2 by the stoppage of said pump P.

2. A method for adjusting starting materials to prepare the starting materials into slurry by dissolution of such starting materials into a solvent, which comprises steps of: charging predetermined quantities of starting materials into an inner cavity of a material blending tank 1 which is constructed in a pressure-resistant and tightly closed version, followed by hermetically sealing the same; filling, in advance, a predetermined quantity of solvent in a large-sized material adjusting tank 2; pumping out said solvent from the bottom part of said material adjusting tank 2 by means of a pump P, and feeding said solvent into the inner cavity of said material blending tank 1 from the bottom part thereof by means of said pump P; stopping operation of said pump P as soon as the air within said material blending tank 1 becomes compressed to a high pressure level, and causing said solvent, which has been pressure forwarded into said material blending tank 1, to flow in the reverse direction into said material adjusting tank 2 through the inner cavity of said pump P under the pressure of air compressed in said material blending tank 1; repeating, for a plurality of number of times, the pressure-feeding of said solvent into said material blending tank 1 by the operation of the pump P, and the reverse flow of said solvent into said material adjusting tank 2 by the stoppage of said pump P; and, thereafter, opening a duct line d, which communicatively connects the upper part of the material blending tank 1 with the material adjusting tank 2, to cause the solution composed of a solvent within said material adjusting tank 2 and the starting material dissolved in said solvent to flow by the operation of the pump P, thereby sending said solution back into said material adjusting tank 2 by way of said material adjusting tank 2, said pump P, said material blending tank 1, and said duct line d.

3. A starting material adjusting apparatus for preparing the starting materials into slurry, which comprises: a material blending tank 1 formed in a tightly closable vessel, and provided with a material charging port 10 which is made tightly closable; a material adjusting tank 2 formed in large-size, and provided with a feeding port 20 of solvent to be filled in the interior of said tank; and a pump P for pressure-feeding said solvent filled in the interior of said material adjusting tank 2 into said material blending tank 1, the intake side of said pump P being connected to a discharge port 2*a* at the bottom part of said material adjusting tank 2 through a pipeline a, while the outlet side of said pump P being connected to a discharge port 13 at the bottom part of said material blending tank 1 through a pipeline b, and said pump P being adapted to enable the solvent to pass through the inner cavity thereof, during its stoppage of operation, in the direction of from the outlet side to the intake side thereof.

4. A starting material adjusting apparatus for preparing the starting materials into slurry, which comprises: a material blending tank 1 formed in a tightly closable vessel, and provided with a material charging port 10 which is made tightly closable; a material adjusting tank 2 formed in large-size, and provided with a feeding port 20 of solvent to be filled in the interior of said tank; and a pump P for pressure-feeding the solvent filled in the interior of said material adjusting tank 2 into said material blending tank 1, the intake side of said pump P being connected to a discharge port 2*a* at the bottom part of said material adjusting tank 2 through a pipeline a, while the outlet side of said pump P being connected to a discharge port 13 at the bottom part of said material blending tank 1 through a pipeline b, and said pump P being adapted to enable the solvent to pass through the inner cavity thereof, during its stoppage of operation, in the direction of from the outlet side to the intake side thereof, and further, the upper part of said material blending tank 1 being communicatively connected to said material adjusting tank 2 through a duct line d which is controlled for its opening and closing by an opening-and-closing valve V6.

5. A starting material adjusting apparatus for adjusting the starting materials into slurry, according to claim 3 or 4, wherein the rotor blade which is axially supported within the casing of said pump P is of an open blade type or a cut blade type having both agitating and shearing forces.

* * * * *